US008794312B2

(12) United States Patent
Stingerie

(10) Patent No.: US 8,794,312 B2
(45) Date of Patent: Aug. 5, 2014

(54) HYDRAULICALLY SET RESETTABLE LINER HANGER

(75) Inventor: Jason C. Stingerie, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 13/272,976

(22) Filed: Oct. 13, 2011

(65) Prior Publication Data

US 2013/0092369 A1 Apr. 18, 2013

(51) Int. Cl.
*E21B 23/00* (2006.01)

(52) U.S. Cl.
USPC ..... 166/208; 166/212

(58) Field of Classification Search
USPC ..... 166/382, 208, 212
See application file for complete search history.

(56) References Cited

U.S. PATENT DOCUMENTS

| | | | | |
|---|---|---|---|---|
| 3,608,634 | A | 9/1971 | Cochran | |
| 4,010,804 | A | 3/1977 | Garcia | |
| 4,489,781 | A | 12/1984 | Weeks | |
| 4,496,000 | A | 1/1985 | Weeks | |
| 4,712,614 | A | 12/1987 | Allwin et al. | |
| 4,828,037 | A * | 5/1989 | Lindsey et al. | 166/382 |
| 4,848,462 | A | 7/1989 | Allwin | |
| 4,862,966 | A * | 9/1989 | Lindsey et al. | 166/382 |
| 8,439,113 | B2 | 5/2013 | Boyle | |
| 8,534,368 | B2 * | 9/2013 | Reimert et al. | 166/382 |
| 2005/0230108 | A1 | 10/2005 | MacKenzie et al. | |
| 2006/0157252 | A1 * | 7/2006 | Dore et al. | 166/358 |
| 2008/0135261 | A1 | 6/2008 | McGilvray et al. | |
| 2009/0090508 | A1 | 4/2009 | Brouse | |
| 2009/0107675 | A1 | 4/2009 | Eriksen et al. | |
| 2010/0038096 | A1 * | 2/2010 | Reimert et al. | 166/382 |
| 2012/0175133 | A1 * | 7/2012 | Nikiforuk | 166/386 |

* cited by examiner

*Primary Examiner* — William P Neuder
(74) *Attorney, Agent, or Firm* — Steve Rosenblatt

(57) ABSTRACT

A liner hanger is locked for run in to prevent accidental setting using a trapped collet assembly. The liner is internally pressurized to push a ring from which the collet extends. The collet heads leave a mandrel groove and compress a return spring while at the same time shouldering against an outer assembly that ramps the slips out on cones for a grip of the surrounding casing. Weight is released and the slips prevent the assembly attached to them from moving to hold the return spring compressed. Picking up weight releases the load on the slips of the hanger and allows the spring to retract the slips and return the collet assembly to the run in position in an exterior mandrel groove. This can be used with a relative rotation feature incorporated into the liner hanger to allow liner rotation during cementing, if desired.

18 Claims, 1 Drawing Sheet

HYDRAULICALLY SET RESETTABLE LINER HANGER

FIELD OF THE INVENTION

The field of the invention is liner hangers and more particularly liner hangers that can be hydraulically set and reset at different subterranean locations.

BACKGROUND OF THE INVENTION

When liner is run through casing the means of support for the liner off the casing is the liner hanger. Traditionally the early liner hangers were held in a retracted position by one or more shear pins to prevent premature setting. Once the target location was reached for the liner hanger near the lower end of the casing the shear pins were broken and the liner hanger was set. Such designs cannot be reset at the same or a different location in the well.

Hydraulically set hangers have been developed that deploy slips radially outwardly when internal pressure is built up on a dropped ball. The internal pressure acts against a bias force on each slip toward the retracted position. The set is accomplished by internal pressurization to extend the slips against a bias force coupled with setting down weight on the mandrel with the slips extended. The weight of the assembly on the extended slips that bite against the surrounding casing would then hold the set. A pickup force that took the weight off the slips allowed the springs to retract the slips so that the liner and the associated hanger could be repositioned to be re-hung at another location with a subsequent deployment of the hanger. The slips are dogs that extend through mandrel openings as shown in US Publication 20090090508. The mandrel wall openings present leak paths around each piston 99 shown in FIGS. 7-9. If the weight is set down before full extension then the small connecting rod 101 can be bent and the dogs 97 may not retract. The limited bearing area for the dogs on the mandrel also limits the loading on the liner hanger.

Other resettable liner hangers are mechanical and generally operate with a j-slot mechanism that requires a combination movement of axial and rotational movement to set and a reversal of such movements to release. In deviated wellbores such movements may be problematic or if the running string is very long or for example coiled tubing then the rotational movements may be difficult to accomplish. Some examples of such designs are U.S. Pat. Nos. 4,496,000; 4,489,781; 4,010,804; 4,712,614 and 3,608,634.

The present invention provides a locking system for a resettable liner hanger that uses collets to prevent accidental setting during run in if the external housing is bumped against a downhole component. It sets hydraulically with a piston to move the collet assembly from the run in to the set position. The movement of the collet assembly compresses a return spring and moves an outer housing to ramp the slips out to the surrounding casing. Setting down weight with the slips extended holds the outer assembly in position against spring force. Picking up allows the spring to return the collet to a mandrel groove, resuming the run in position. These and other features of the present invention will be more apparent to those skilled in the art from a review of the detailed description of the preferred embodiment and the associated drawings while recognizing that the full scope of the invention is to be determined from the appended claims.

SUMMARY OF THE INVENTION

A liner hanger is locked for run in to prevent accidental setting using a trapped collet assembly. The liner is internally pressurized to push a ring from which the collet extends. The collet heads leave a mandrel groove and compress a return spring while at the same time shouldering against an outer assembly that ramps the slips out on cones for a grip of the surrounding casing. Weight is released and the slips prevent the assembly attached to them from moving to hold the return spring compressed. Picking up weight releases the load on the slips of the hanger and allows the spring to retract the slips and return the collet assembly to the run in position in an exterior mandrel groove. This can be used with a relative rotation feature incorporated into the liner hanger to allow liner rotation during cementing, if desired.

DETAILED DESCRIPTION OF THE PREFERRED EMBODIMENT

Figure 1:
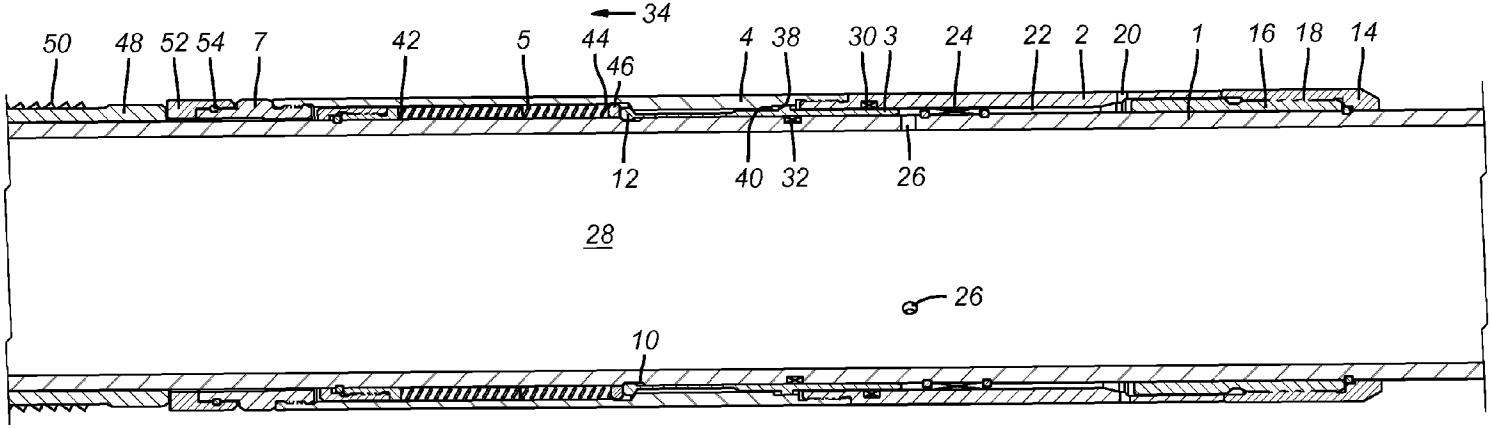
FIG. 1 is a section view of the resettable lock in the run in position.
Figure 2:
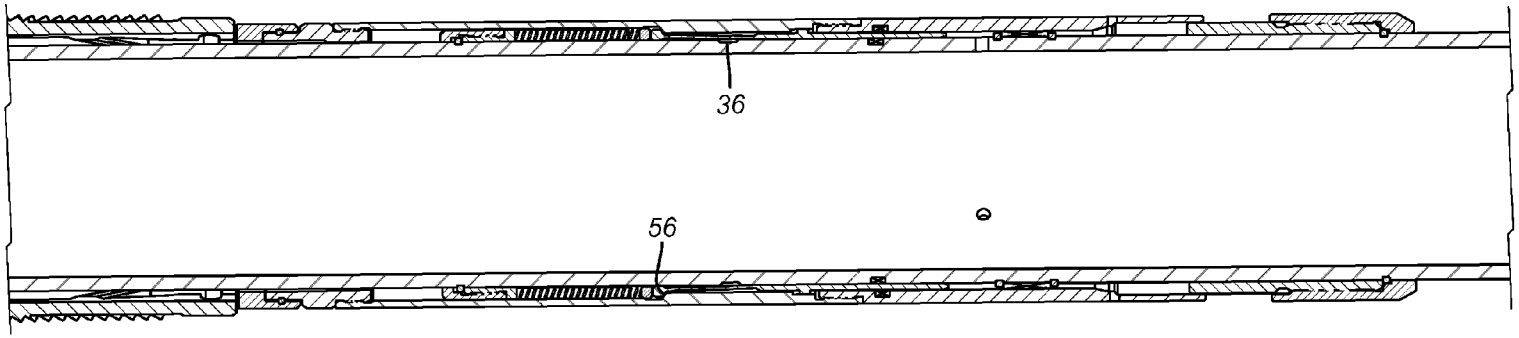
FIG. 2 is the view of FIG. 1 in the liner hanger set position.

Referring to FIG. 1 the mandrel 1 has a groove 10 in which a collet head assembly 12 is initially located for running in. Ring 14 is secured to mandrel 1 in a fixed relation and overlies ring 16 with thread 18 connecting them. Outer sleeve 2 is movably mounted over ring 16 and has one or more open holes 20 to allow well fluid into and out of annular space 22 that is defined between the mandrel 1 and the outer sleeve 2. Seal 24 is attached to mandrel 1 just below ports 26 that allow communication from mandrel passage 28 into annular space 22 above the seal 24. Collet assembly 3 which is a ring with extending collet fingers that terminate at heads 12 is located in the annular space 22 and has seals 30 and 32 on opposite sides thereof. When pressure is applied in passage 28 such as by dropping a ball on a seat (not shown) and building pressure through ports 26, the pressure is retained by seals 24, 30 and 32 and the end result is that the collet assembly 3 which comprises a base ring and a plurality of fingers with heads 12 at their ends, moves uphole in the direction of arrow 34. Such movement takes the heads 12 out of groove 36 as seen in FIG. 2. The spring 5 is also compressed as seen by comparing it in FIGS. 1 and 2.

As the collet assembly 3 moves in the direction of arrow 34, an external shoulder 38 catches on an undercut 40 on the retainer sleeve 4 so that after an initial movement that took the collet heads 12 out of groove 36 the movement of the retainer sleeve 4 and the collet assembly 3 is in tandem. A spring retainer 6 is fixed to mandrel 1 to hold end 42 of spring 5 stationary as the opposite end 44 of spring 5 is moved in the direction of arrow 34. An end ring 46 is against end 44 of spring 5 and abuts a matching flat on the collet heads 12. Those skilled in the art will appreciate that the configuration of the collet heads 12 and the groove 36 in mandrel 1 as well as the taper in retainer sleeve 4 that engages the heads 12 are disposed at the necessary angles so that a jarring blow to the retainer sleeve 4 in the direction of arrow 34 during run in when retainer sleeve 4 is advanced downhole in an opposite direction to arrow 34 will not allow any movement of the retainer sleeve 4 in an uphole direction. During run in there is no pressure in passage 28 that is applied from the surface. It will take applied pressure in passage 28 through ports 26 to get the collet heads to exit groove 36 in mandrel 1. As will be explained below it will take movement of the collet assembly 3 taking the retainer sleeve 4 with it to ultimately allow the slips 48 to radially extend on ramps or cones that are not shown so that the wickers 50 bite into the surrounding casing also not shown.

Movement of the retainer sleeve 4 in the direction of arrow 34 takes swivel sleeve 7 in the same direction. Swivel sleeve 7 allows slips 48 to avoid turning as the mandrel 1 and associated exterior components described above are rotated when the mandrel 1 that is connected to a liner string that is not shown is turned as a cementing job takes places to aid in even distribution of the cement in the surrounding annular space to the liner string. Ring 52 is secured to swivel sleeve 7 at retainer 54 so that relative rotation can take place between the swivel sleeve 7 that turns and the ring 52 that does not turn.

When the wickers 50 bite into the surrounding casing or tubular, weight it set down and the weight of the string that is not shown and that is connected to mandrel 1 holds the slips 48 in position to support the liner string. As seen in FIG. 2, the spring 5 remains in compression because the retainer sleeve 4 cannot move as long as the slips 48 maintain a grip on the surrounding tubular. The set slips 48 hold the swivel 7 and the retainer sleeve 4 fixed in a position where the collet heads 12 are now above the groove 36 as shown in FIG. 2. The collet heads 12 are effectively trapped and under a retention force from spring 5 against surface 56 of retainer sleeve 4.

A pick up force applied to mandrel 1 releases the load on the slips 48 allowing the spring 5 to push the collet heads 12 in a direction opposite to arrow 34 back to groove 36 in mandrel 1 which in turn will radially retract the slips 48 so that the FIG. 1 position is resumed and the slips 48 are in the retracted position and will stay in that position as the mandrel 1 and liner string that is attached to it are repositioned. The setting process can then be repeated.

Those skilled in the art will appreciate that the present invention allows a liner hanger to be reset with a feature that keeps it from setting as it is moved. Setting is accomplished with internal pressure though one or more ports that extends into a sealed annular space. Rotation is not required. Slip actuation is with axial movement of the external components to allow a larger load capacity on the slips than radially extending dogs through a mandrel wall as is done in US Publication 20090090508. Shear pins are not used and the design is resettable and locked against set when being moved.

The above description is illustrative of the preferred embodiment and many modifications may be made by those skilled in the art without departing from the invention whose scope is to be determined from the literal and equivalent scope of the claims below.

I claim:

1. A resettable liner hanger mechanism for support of a first tubular string from a surrounding string at a subterranean location, comprising:

a mandrel;

at least one axially movable slip that moves radially as said slip moves axially;

a non-shearing lock assembly further comprising a resettable collet in a groove and having a first position locking said slip to said mandrel and a second axially displaced position to radially move said slip.

2. The mechanism of claim 1, wherein:

said lock assembly further comprises at least one movable sleeve selectively retaining a locking member to said mandrel.

3. The mechanism of claim 1, wherein:

said slip is mounted wholly outside said mandrel.

4. The mechanism of claim 1, wherein:

said at least one collet comprising a plurality of spaced collets extending from a base ring.

5. The mechanism of claim 1, wherein:

said mandrel and lock assembly are rotatably mounted with respect to said slip.

6. A resettable liner hanger mechanism for support of a first tubular string from a surrounding string at a subterranean location, comprising:

a mandrel;

at least one axially movable slip that moves radially as said slip moves axially;

a lock assembly having a first position locked to said mandrel and a second axially displaced position to radially move said slip;

said lock assembly further comprises at least one movable sleeve selectively retaining a locking member to said mandrel;

said mandrel comprising at least one surface irregularity that selectively retains at least one collet when said lock assembly is in said first position;

said surface irregularity comprises at least one groove;

said movable sleeve is locked to said mandrel against movement toward said slip by said collet in said groove.

7. The mechanism of claim 6, wherein:

said collet can only exit said groove with pressure applied to said collet from a passage in said mandrel.

8. The mechanism of claim 7, wherein:

said mandrel comprising at least one port to communicated to a sealed variable annular volume formed in part by said collet.

9. The mechanism of claim 8, wherein:

said collet is biased away from said slip by a biasing element supported on said mandrel.

10. The mechanism of claim 9, wherein:

pressure applied to said annular volume moves said collet toward said slip while overcoming said biasing element.

11. The mechanism of claim 10, wherein:

said movable sleeve is engaged by said collet for movement toward said slip.

12. The mechanism of claim 11, wherein:

said collet engages said movable sleeve after compressing said biasing element.

13. The mechanism of claim 11, wherein:

said at least one movable sleeve comprises a plurality of movable sleeves, at least one of which rotates with said mandrel.

14. The mechanism of claim 11, wherein:

said movable sleeve retains said collet against said biasing element in a compressed state of said biasing element brought about by movement of said movable sleeve toward said slip.

15. The mechanism of claim 14, wherein:

said movable sleeve comprises an interior shoulder to trap said collet to said mandrel at a location axially away from said groove when said slip supports the weight of said mandrel from the surrounding string.

16. The mechanism of claim 15, wherein:

said movable sleeve is held fixed by said slip when said slip supports the weight of said mandrel from the surrounding string.

17. The mechanism of claim 16, wherein:

said slip is released from engagement with the surrounding string with an axial force applied to said mandrel.

18. The mechanism of claim 15, wherein:

release of said slip from engagement with the surrounding string allows said biasing element to move said movable sleeve axially and return said collet to said groove where said lock assembly resumes said first position.

* * * * *